United States Patent [19]

Yorifuji et al.

[11] Patent Number: 4,972,118

[45] Date of Patent: Nov. 20, 1990

[54] AMALGAM HAVING EXTENDED STABLE MERCURY VAPOR PRESSURE RANGE AND LOW MERCURY VAPOR PRESSURE DISCHARGE LAMP USING THE SAME

[75] Inventors: Takashi Yorifuji, Zushi; Seiko Komoda, Yokosuka, both of Japan

[73] Assignee: Kabushiki Kaisha Toshiba, Kawasaki, Japan

[21] Appl. No.: 304,656

[22] Filed: Feb. 1, 1989

[30] Foreign Application Priority Data

Feb. 2, 1988 [JP] Japan ..... 63-21366

[51] Int. Cl.[5] ..... H01J 17/26

[52] U.S. Cl. ..... 313/565; 313/450; 313/550

[58] Field of Search ..... 313/565, 490, 547, 550

[56] References Cited

U.S. PATENT DOCUMENTS

| | | | |
|---|---|---|---|
| 3,227,907 | 1/1966 | Bernier et al. | 313/490 X |
| 4,105,910 | 8/1978 | Evans | 313/490 |
| 4,393,325 | 7/1983 | van der Kooi | 313/552 |
| 4,615,846 | 10/1986 | Yoshino et al. | 264/178 F X |
| 4,636,686 | 1/1987 | Vrieze | 313/565 |

FOREIGN PATENT DOCUMENTS

| | | | |
|---|---|---|---|
| 1274228 | 8/1968 | Fed. Rep. of Germany | 313/552 |
| 44-44976 | 12/1972 | Japan . | |
| 57-7463 | 2/1982 | Japan . | |
| 58-21067 | 5/1983 | Japan . | |
| 156630 | 7/1986 | Japan | 313/490 |

*Primary Examiner*—Donald J. Yusko
*Assistant Examiner*—Michael Horabik
*Attorney, Agent, or Firm*—Cushman, Darby & Cushman

[57] ABSTRACT

An amalgam has a base metal including bismuth in an amount selected from the range between about 45 wt % and 65 wt %, and lead in an amount selected from the range between about 35 wt % and 55 wt %. The amalgam also includes mercury the amount of which is selected from the range between about 1 wt % and 12 wt % of the total amount of the amalgam. Such amalgam is sealed in a low mercury vapor pressure discharge lamp which operates at a medium bulb surface temperature to achieve a stable mercury vapor pressure over an extended amalgam temperature range.

16 Claims, 5 Drawing Sheets

AMALGAM HAVING EXTENDED STABLE MERCURY VAPOR PRESSURE RANGE AND LOW MERCURY VAPOR PRESSURE DISCHARGE LAMP USING THE SAME

BACKGROUND OF THE INVENTION

1. Field of the Invention

This invention relates, in general, to mercury vapor pressure control materials used for a mercury vapor discharge lamp. In particular, the invention relates to an amalgam sealed in a bulb to control the mercury vapor pressure in the bulb within a prescribed range during the operation. The invention also relates to a low mercury vapor pressure discharge lamp, using the above-described amalgam, which operates under a medium bulb surface temperature, e.g., 60° C. or 70° C.

2. Description of the Related Art

In general, a low mercury vapor pressure discharge lamp, e.g., straight type fluorescent lamp, is provided with pure mercury. The mercury vapor pressure in the bulb is maintained at substantially $6.0\times10^{-3}$ torr when the bulb surface temperature is 40° C. Under such a mercury vapor pressure described above, the fluorescent lamp can operate at its desirable characteristics.

In recent years, small sized fluorescent lamps, called ball-type fluorescent lamps, have been developed. In one of the ball-type fluorescent lamps (hereafter referred to as a high temperature ball-type lamp), the bulb is bent and is housed in a small sized hermetic globe together with a ballast. In this type of the lamp, since heat radiated from the bulb and the ballast does not readily escape from the globe, the bulb surface temperature of the lamp increases above 90° C. during the operation. In this case, the luminous flux of the lamp decreases if the mercury vapor pressure in the bulb increases excessively. To control the mercury vapor pressure within a prescribed range, an amalgam, such as, e.g., bismuth (Bi)-indium (In)-amalgam, etc., is sealed in the bulb. Such amalgam controls the mercury vapor pressure in the bulb at a desirable value when the bulb surface temperature is about 90° C.

On the other hand, another ball-type fluorescent lamp in which the ballast is attached to the outside of the globe also has been developed, as a low mercury vapor pressure discharge lamp. In this type of lamp (hereafter referred to as a low temperature ball-type lamp), a small fluorescent lamp which has a U-shaped discharge pass or an H-shaped discharge pass and operates under a high wall loading above 500 $W/m^2$, is used.

In such a low mercury vapor pressure discharge lamp described above, the bulb surface temperature is low, as compared with the above-described high temperature ball-type fluorescent lamp in which the amalgam is sealed. However, the bulb surface temperature of the above-described low temperature ball-type lamp is relatively high, as compared with the conventional straight-type fluorescent lamp in which pure mercury is sealed. In this case, a desirable luminous flux of the low temperature ball-type lamp is not achieved even if the above-described bismuth-indium-amalgam is sealed in the bulb to control the mercury vapor pressure.

This is because the bulb surface temperature of the low temperature ball-type lamp is low, as described above. Therefore, such amalgams described above do not operate efficiently. In this case also, if pure mercury is used rather than the above-described amalgams, the mercury vapor pressure in the low temperature ball-type lamp increases to an excessive level, and thus, a desirable luminous flux also is not achieved.

SUMMARY OF THE INVENTION

Accordingly, it is an object of the present invention to effectively control the mercury vapor pressure in a low mercury vapor pressure discharge lamp which operates under a relatively low or medium range bulb surface temperature.

According to one aspect of the present invention, an amalgam comprises a base metal including bismuth in an amount selected from the range between about 45 wt % and 65 wt % and lead in an amount selected from the range between about 35 wt % and 55 wt %, and mercury in an amount selected from the range between about 1.0 wt % and 12 wt % of a total amount of the amalgam. The base metal may include lead in an amount selected from the range between about 30 wt % and 55 wt %, instead of the range between 35 wt % and 55 wt %, and indium in an amount selected from the range between zero wt % and 10 wt %.

According to another aspect of the present invention, a low mercury vapor pressure discharge lamp includes a bulb having a pair of ends, an electrode disposed at each end of the bulb, and an amalgam sealed in the bulb, which comprises a base metal including about 45 wt % to 65 wt % bismuth and about 35 wt % to 55 wt % lead, also with about 1.0 wt % to 12 wt % mercury to the total amount of the amalgam. The base metal of the amalgam sealed in the bulb may include lead in an amount selected from the range between about 30 wt % and 55 wt %, instead of the range between 35 wt % and 55 wt %, and indium in an amount selected from the range between zero wt % and 10 wt %. The bulb of the low mercury vapor pressure discharge lamp may include a convoluted discharge pass therein.

BRIEF DESCRIPTION OF THE DRAWINGS

These and other objects and advantages of this invention will become more apparent and more readily appreciated from the following detailed description of the presently preferred exemplary embodiments of the invention, taken in conjunction with the accompanying drawings, wherein like reference numerals throughout the various figures denote like structure elements and wherein.

DETAILED DESCRIPTION OF THE PREFERRED EMBODIMENTS

Figure 1:
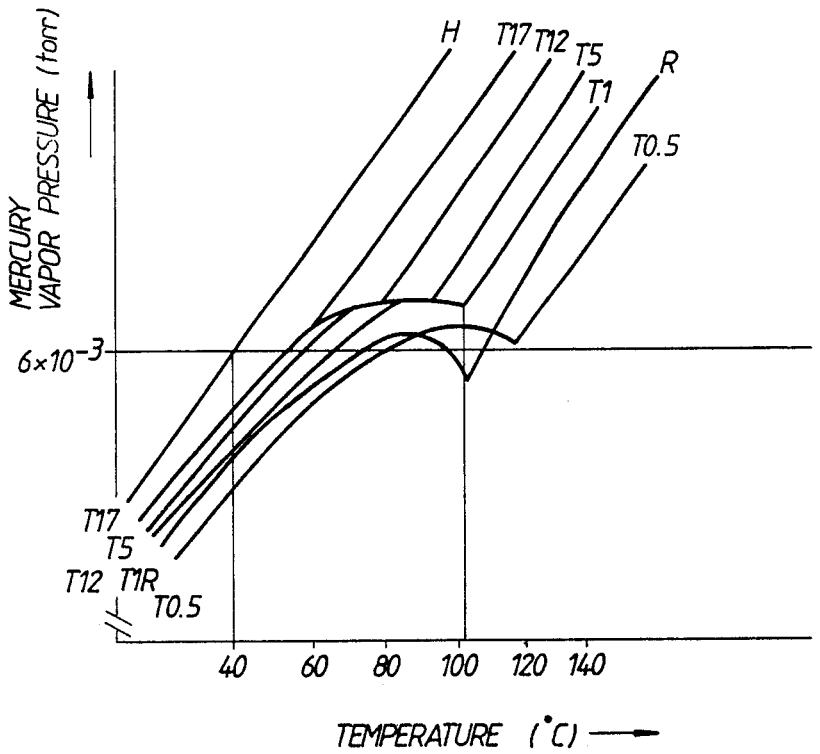
FIG. 1 is a graph illustrating changes in the mercury vapor pressure of various amalgam samples including the present invention, pure mercury and a conventional amalgam when the amalgam or mercury temperature is changed.

A first embodiment of the present invention will be described by referring to FIG. 1. Samples of an amalgam including bismuth (Bi), lead (Pb) and mercury (Hg) with varying compositions were tested. The transition of the mercury vapor pressure of each sample was observed by varying the temperature of the samples. Five amalgam samples were made by varying an amount of mercury added to a base metal, which included 56.5 wt % bismuth and 43.5 wt % lead. The first amalgam sample (T0.5) included 0.5 wt % mercury, taking the gloss weight of the amalgam as 100. The second amalgam sample (T1.0) also included 1.0 wt % mercury and the third amalgam sample (T5) included 5.0 wt % mercury. The fourth amalgam sample (T12) included 12.0 wt % mercury, and the fifth amalgam sample (T17) includes 17.0 wt % mercury. Changes in the mercury vapor pressure of each amalgam sample were compared with those of pure mercury and a conventional amalgam, including 64.3 wt % bismuth, 31.7 wt % indium and 4.0 wt % mercury. FIG. 1 shows the changes of the mercury vapor pressure for each amalgam sample. The curved lines T17, T12, T1 and T0.5 indicate the transition of the mercury vapor pressure of the above-described five amalgam samples, respectively. The numeral suffix of each reference symbol T17, T12, and T0.5 denotes the amount of mercury added to each base metal of the above-described five amalgam samples. The curved line H indicates the transition of the mercury vapor pressure of the pure mercury, and the curved line R indicates the transition of the mercury vapor pressure of the bismuth-indium amalgam (conventional amalgam).

As can be seen in FIG. 1, the amalgam including 17 wt % mercury has an extremely narrow temperature stable range and a high mercury vapor pressure, as indicated by curved line T17. Thus, the luminous flux decreases when the above-described amalgam including 17 wt % mercury is used in a lamp which operates under a relatively low bulb surface temperature, e.g., 60° C. or 70° C. On the contrary, the amalgam including 12 wt % mercury, the amalgam including 5 wt % mercury, and the amalgam including 1 wt % mercury all have a desirable temperature stable range, as indicated by each curved line T12, T5, T1. Furthermore, a stable temperature of the amalgam including bismuth-lead-mercury is achieved when the amount of mercury added to the above-described amalgam is small.

Figure 2:
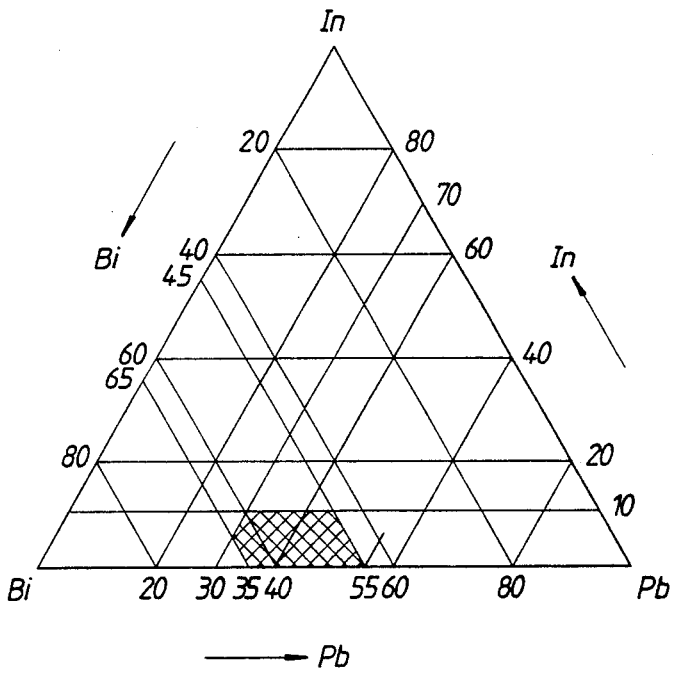
FIG. 2 is a ternary composition diagram illustrating the composition ratio among bismuth, lead and indium for the base metal of the invention.

Consideration of the amount of bismuth and the amount of lead included in the base metal of the amalgam may be made by referring to the bismuth-lead-indium ternary composition diagram shown in FIG. 2. In FIG. 2, the line of zero indium indicates only two components of bismuth and lead. In general, an alloy of bismuth and lead is called a eutectic alloy, and the composition ratio (wt %) between bismuth and lead at the eutectic point is 56.3:43.5. Several samples were made by varying the composition ratio of bismuth and lead. It was observed that the samples of the above-described composition ratio or a composition ratio close to the above-described composition ratio were suitable. Based on the result of the experiment, the composition of the base metal was determined such that it includes 45 wt % to 65 wt % bismuth and 35 wt % to 55 wt % lead. The amalgam is made by adding 1.0 wt % to 12 wt % mercury to the base metal as compared to the total amount of the amalgam.

Figure 3:
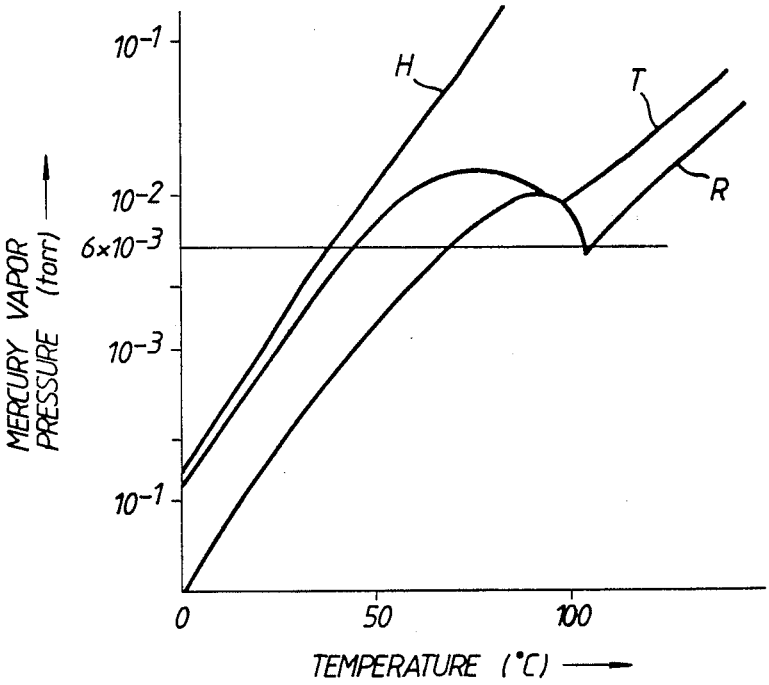
FIG. 3 is a graph illustrating changes in the mercury vapor pressure of an amalgam of another embodiment, the conventional amalgam and pure mercury when the amalgam or mercury temperature is changed.

A second embodiment of the present invention will now be described with reference to FIG. 3. In the second embodiment, the amalgam includes bismuth (Bi), lead (Pb), indium (In), and mercury (Hg). In general, the mercury vapor pressure of an amalgam is reduced by adding indium to the amalgam, and is controlled by the amount of the indium added to the amalgam. The mercury vapor pressure of an amalgam sample including 52 wt % bismuth, 42 wt % lead, 3 wt % indium and 3 wt % mercury was measured at varying temperatures. FIG. 3 shows the result of the experiment. For the purpose of the comparison, FIG. 3 also shows changes in the mercury vapor pressure of pure mercury and a conventional amalgam including 64.3 wt % bismuth, 31.7 wt % indium and 4.0 wt % mercury. In FIG. 3, line H indicates changes in the mercury vapor pressure of the pure mercury, and curved line T indicates changes in the mercury vapor pressure of the amalgam sample of the second embodiment. Curved line R indicates changes in the mercury vapor pressure of the conventional amalgam.

As can be seen in FIG. 3, the mercury vapor pressure of the second embodiment varies between that of the pure mercury and the conventional amalgam. The amalgam sample of the second embodiment shows a mercury vapor pressure change close to that of the pure mercury on the lower temperature side and also shows a mercury vapor pressure change close to that of the conventional amalgam on the upper temperature side. Thus, the amalgam sample of the second embodiment has a desirable mercury vapor pressure within a relatively wide temperature range, as compared with the pure mercury and the conventional amalgam.

In accordance with the ternary composition diagram shown in FIG. 2, the weight ratio of three components, i.e., bismuth, lead and indium, each of which is a component of the base metal of the amalgam sample of the second embodiment can be considered. The mercury vapor pressure of an amalgam sample was measured by varying the composition ratio between the base metal and mercury of the amalgam sample. Changes in the mercury vapor pressure of the amalgam sample close to the curve T shown in FIG. 3 were observed when the base metal of the amalgam sample included 45 wt % to 65 wt % bismuth, 30 wt % to 55 wt % lead and zero wt % to 10 wt % indium, and the amalgam included 1 wt % to 12 wt % mercury. The above-described composition range of bismuth, lead and indium in the base metal is indicated by the meshed area in FIG. 2. In particularly, if the amount of bismuth increases above the above-described range, a substantially flat mercury vapor pressure range shifts toward an upper mercury vapor pressure side, e.g., $1\times10^{-1}$ torr. On the contrary, if the amount of bismuth decreases below the above-described range, the mercury vapor pressure extremely decreases when the temperature is low, and thus, the low temperature portion of curve T shown in FIG. 3 approaches that of the conventional amalgam. If the amount of indium increases above 10 wt %, curve T shown in FIG. 3 shifts toward the lower mercury vapor pressure side. Furthermore, as the amount of mercury increases above the above-described range, the range in which the mercury vapor pressure is stable becomes narrow and close to curve H shown in FIG. 3. If the amount of mercury is excessively small, a shortage of mercury would occur because of the consumption of mercury during the operation.

Figure 4:
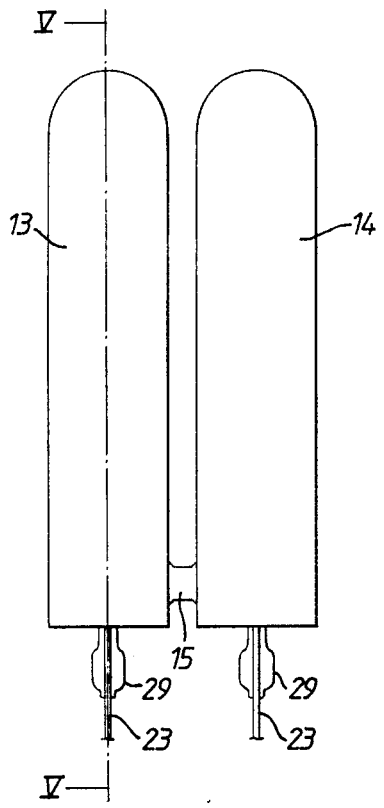
FIG. 4 is a side view illustrating a double U-shaped fluorescent lamp wherein the amalgam of the first or the second embodiment is sealed.
Figure 5:
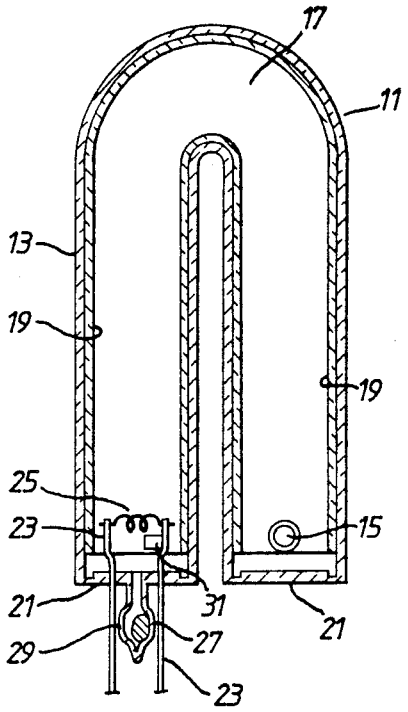
FIG. 5 is a cross sectional view taken on line V—V of FIG. 4.

As shown in FIGS. 4 and 5, the amalgam of the first embodiment is sealed in a double U-shaped fluorescent lamp. Double U-shaped fluorescent lamp 11 includes two U-shaped glass tubes 13 and 14 which are connected by a connecting tube 15. A convolute discharge pass 17 is formed in tubes 13 and 14. A fluorescent film 19 is formed on the inner surface of each U-shaped glass tube 13, 14. An end portion of each U-shaped glass tube 13, 14 is sealed by a stem 21. A pair of lead wires 23, 23 extend into the inside of glass tube 13 through one of the stems 21, and a coiled filament 25 is fixed between lead wire 23 and 23. A main amalgam 27 is sealed in an exhausting tube 29 outwardly extending from stem 21 into which the pair of lead wires 23, 23 extends. An auxiliary amalgam 31 is fixed to one of the lead wires 23. Auxiliary amalgam 31 is plate shaped molybdenum or stainless steel which is coated with indium. Such plate shaped molybdenum or stainless steel is amalgamated before or after being sealed in the bulb. An amalgam, including 52.2 wt % bismuth, 41.8 wt % lead and 4 wt % mercury is used as the main amalgam. Since the construction of the other U-shaped glass tube 14 is the same as that of U-shaped glass tube 13 ', the same numerals are applied to similar portions of U-shaped glass tube 14, and therefore, the description thereof is not repeated. The above-described fluorescent lamp 11 also includes and outer globe (not shown) in which glass tubes 13 and 14 are located. A ballast (not shown) is attached to the outside of the globe. However, the ballast may be assembled with lamp 11 if the globe is not used. The above-described double U-shaped fluorescent lamp 11 has a 27 W rating, and operates at a high wall loading above 500 $W/m^2$, e.g., 700 $W/m^2$.

The operation of the above-described lamp will be described hereafter. When each coiled filament 25 in tubes 13 and 14 is energized, auxiliary amalgam 31 is dissolved by heat generated by coiled filament 25 and mercury vapor from auxiliary amalgam 31. At this time, mercury in main amalgam 27 does not evaporate because of the low temperature of exhausting tube 29. Discharge occurs between coiled filaments 25 when a starting voltage is applied to coiled filaments 25. Since exhausting tube 29 is heated by the discharge, main amalgam 27 also is heated and mercury in main amalgam evaporates. As a result, the mercury vapor pressure in bulbs 13 and 14 rapidly increases and the discharge between coiled filaments 25 becomes stable. After main amalgam 27 is activated, the mercury vapor pressure in bulbs 13 and 14 chiefly depends on the temperature of main amalgam 27. When coiled filaments 25 in tubes 13 and 14 are deenergized, the temperatures of main amalgam 27 and auxiliary amalgam 31 gradually decrease. At first, since auxiliary amalgam 31 is coated with indium, a part of the vapored mercury is absorbed by auxiliary amalgam 31 and is amalgamated. Then, the remaining vapored mercury is also absorbed by main amalgam 27 and is amalgamated.

In the above-described lamp, since four straight tube portions of double U-shaped fluorescent lamp 11 are closely arranged in parallel, the bulb surface temperature of each straight portion increases similar to that of the above-described conventional ball-type fluorescent lamp (high temperature ball-type lamp), i.e., 90° C. However, in this U-shaped fluorescent lamp, since the amalgam of the invention is used as main amalgam 27, the mercury vapor pressure in U-shaped glass tubes 13 and 14 is controlled at a desirable range even though main amalgam 27 is heated to a relatively high temperature. Using a double U-shaped fluorescent lamp 11, a desirable luminous flux was obtained even when the temperature of main amalgam 27 was varied within a relatively wide range, i.e., between 40° C. and 105° C., as compared with a lamp which uses the conventional amalgam. A suitable temperature of the conventional amalgam exists only at a relatively high temperature side.

Figure 6:
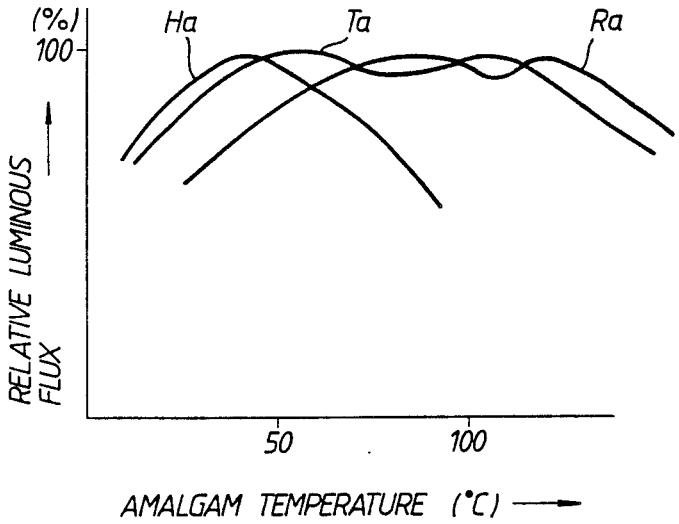
FIG. 6 is a graph illustrating changes in the luminous flux of the double U-shaped fluorescent lamp of FIG. 4, and a conventional U-shaped fluorescent lamp wherein either pure mercury or the conventional amalgam is sealed.

The amalgam of the second embodiment was sealed in the double U-shaped fluorescent lamp shown in FIGS. 4 and 5, as a main amalgam, instead of the amalgam of the first embodiment. An experiment was carried out by using an amalgam sample including 50 wt % bismuth, 45 wt % lead, 2 wt % indium and 3 wt % mercury. In the experiment, the relationship between the amalgam temperature and the relative luminous flux of the double U-shaped fluorescent lamp was observed. FIG. 6 shows the result of the experiment. In FIG. 6, curve Ta indicates changes in the luminous flux of the double U-shaped fluorescent lamp wherein the above-described amalgam sample is sealed when the amalgam temperature is changed. For the purpose of the comparison, curve Ra indicates changes in the luminous flux of a double U-shaped fluorescent lamp wherein the conventional amalgam is sealed, and curve Ha indicates changes in the luminous flux of a double U-shaped fluorescent lamp wherein pure mercury is sealed.

As can be seen in FIG. 6, the luminous flux is greatly improved at the lower temperature side, as compared with the lamp in which the conventional amalgam is sealed. Thus, a stable luminous flux is achieved over an extended temperature range between 40° C. and 110° C.

Figure 7:
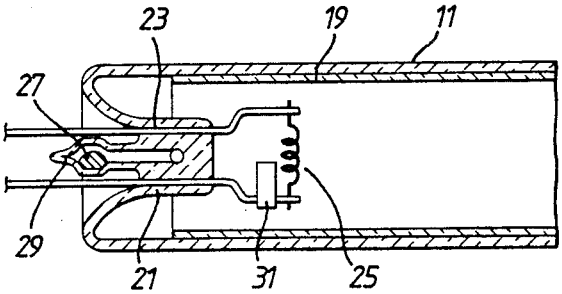
FIG. 7 is a cross sectional view illustrating one of the ends of a straight-type fluorescent lamp.

In the above-described lamps, the amalgam of either the first or the second embodiment is used in the double U-shaped fluorescent lamp which operates at a high wall loading above 500 $W/m^2$. However, such amalgam may be used in a double U-shaped fluorescent lamp which operates at a relatively low wall loading below 500 $W/m^2$ if the temperature around the lamp is high. Furthermore, in those lamps, the amalgam of the first or the second embodiment is sealed in the double U-shaped fluorescent lamp. However, the amalgam of the first or the second embodiment may be sealed in a straight-type fluorescent lamp, as shown in FIG. 7. Similar effects can also be obtained in the straight-type fluorescent lamp. In FIG. 7, the same numerals are applied to the construction similar to the double U-shaped fluorescent lamp shown in FIG. 4, and therefore, the description thereof is not repeated.

In summary, it will be seen that the present invention overcomes the disadvantage of the prior art and provides an improved amalgam and a low mercury vapor pressure discharge lamp in which an extended stable mercury vapor pressure is achieved over a wide amalgam temperature range, as compared with a low mercury vapor pressure discharge lamp in which the conventional amalgam or pure mercury is sealed.

Many changes and modifications in the above-described embodiments can be carried out without departing from the scope of the present invention. Therefore, the appended claims should be construed to include all such modifications.

What is claimed is:

1. A low mercury vapor pressure discharge lamp comprising:

a light permeable tube having sealed ends, the tube including a quantity of mercury vapor sealed therein;

an amalgam sealed in the light permeable tube, the amalgam including only a base metal having about 45 wt % to 65 wt % bismuth, and about 35 wt % to 55 wt % lead, and mercury in an amount selected from the range between about 1 wt % and 12 wt % of the total amount of the amalgam; and means for establishing an electrical discharge in the tube.

2. A lamp according to claim 1, wherein the discharge means includes an electrode arranged at each of the sealed ends.

3. A lamp according to claim 2 also including an auxiliary amalgam fixed to one of the electrodes, the auxiliary amalgam containing molybdenum or stainless steel and including a coating of indium on the metal.

4. A lamp according to claim 3, wherein the light permeable tube is linear between the electrodes.

5. A lamp according to claim 3, wherein the light permeable tube includes a curved portion between the electrodes.

6. A lamp according to claim 5 also including a globe substantially surrounding the tube.

7. A lamp according to claim 6 also including a ballast outside the globe.

8. A lamp according to claim 5 also including a ballast separate from the tube.

9. A low mercury vapor pressure discharge lamp comprising:

a light permeable tube having sealed ends, the tube including a quantity of mercury vapor sealed therein;

an amalgam sealed in the light permeable tube, the amalgam including a base metal having about 45 wt % to 65 wt % bismuth, about 30 wt % to 55 wt % lead and zero wt % to less than 4 wt % indium, and mercury in an amount selected from the range between about 1 wt % and 12 wt % of the total amount of the amalgam; and means for establishing an electrical discharge in the tube.

10. A lamp according to claim 9, wherein the discharge means includes an electrode arranged at each of the sealed ends.

11. A lamp according to claim 10 also including an auxiliary amalgam fixed to the one of the electrodes, the auxiliary amalgam containing molybdenum or stainless steel and including a coating of indium on the metal.

12. A lamp according to claim 11, wherein the light permeable tube is linear between the electrodes.

13. A lamp according to claim 11, wherein the light permeable tube includes a curved discharge portion between the electrodes.

14. A lamp according to claim 13 also including a globe substantially surrounding the tube.

15. A lamp according to claim 14 also including a ballast outside the globe.

16. A lamp according to claim 13 also including a ballast separate from the tube.

* * * * *